US006042203A

United States Patent [19]

Bogucki

[11] Patent Number: 6,042,203

[45] Date of Patent: Mar. 28, 2000

[54] MOUNTING ASSEMBLY FOR WORK STATION CONSOLE

[75] Inventor: Peter Bogucki, Kings Park, N.Y.

[73] Assignee: Infra-Structures, Inc., Brentwood, N.Y.

[21] Appl. No.: 09/268,018

[22] Filed: Mar. 15, 1999

Related U.S. Application Data

[62] Division of application No. 08/842,439, Apr. 24, 1997, Pat. No. 5,954,408.

[51] Int. Cl.[7] ..... A47B 81/00

[52] U.S. Cl. ..... 312/223.3; 312/223.2; 312/277; 312/321; 248/419; 248/242; 248/396; 108/143; 108/147.17

[58] Field of Search ..... 312/223.2, 132, 312/223.3, 194, 133, 277, 306, 321; 248/419, 298.1, 242, 393, 398, 371, 244, 396; 108/143, 147.11, 147.17, 50.01, 50.02

[56] References Cited

U.S. PATENT DOCUMENTS

| | | | |
|---|---|---|---|
| 569,640 | 10/1896 | Hartzell | 248/244 |
| 1,181,224 | 5/1916 | Jaiger | 248/396 X |
| 1,210,199 | 12/1916 | Passeck | 248/244 |
| 2,430,656 | 11/1947 | Wright | 248/419 |
| 3,162,416 | 12/1964 | Amarillas | 248/244 |
| 3,710,096 | 1/1973 | McFarlin | 248/244 X |
| 4,827,439 | 5/1989 | Licht | 312/313 X |
| 5,048,784 | 9/1991 | Schwartz et al. | 248/244 |
| 5,309,686 | 5/1994 | Underwood et al. | 312/223.3 X |
| 5,483,902 | 1/1996 | Grosch | 108/143 |

FOREIGN PATENT DOCUMENTS

| | | | |
|---|---|---|---|
| 54206 | 7/1912 | Australia | 248/244 |
| 6410236 | 3/1965 | Netherlands | 248/244 |
| 526562 | 5/1931 | United Kingdom | 108/143 |
| 1003183 | 9/1965 | United Kingdom | 248/419 |

*Primary Examiner*—Peter M. Cuomo
*Assistant Examiner*—David E. Allred
*Attorney, Agent, or Firm*—Bauer & Schaffer, LLP

[57] ABSTRACT

A console enclosure for supporting various computer or electronic components including an adjustable monitor supporting shelf within the enclosure, and adjustable keyboard table and a shielding canopy.

5 Claims, 4 Drawing Sheets

MOUNTING ASSEMBLY FOR WORK STATION CONSOLE

RELATED APPLICATION

This application is a divisional of a application, U.S. patent application Ser. No. 08/842,439 filed Apr. 24, 1997, now U.S. Pat. No. 5,954,408 issued Sep. 21, 1999 and entitled Console for Electronic Work Stations, for which benefit under 37 U.S.C. 120 is claimed.

BACKGROUND OF THE INVENTION

The present invention relates to a console for supporting computer equipment and in particular, to a mounting assembly to enable the selective positioning of the console components by different operators.

To date there have been many work station consoles manufactured, however, the majority of these systems have been intended for a singular work station or a few isolated work stations. These systems are not intended, nor suited, to be used in large scale control room settings where there may be tens of work stations ganged together in relatively small confines. Such installations are intended for virtual continuous use with one operator replacing another without the need for resetting and readjusting of the electronic components between shifts.

Those systems that have been proposed for use in larger applications tend to be complex in construction and expensive. Also, the prior art has been limited in the number of console structures and shapes that could be achieved utilizing their elemental components. The prior art has also been limited in the size and variety of computer equipment they could accommodate, as well as the ability to set up such stations for the most convenient use by several individual operators.

A particular problem found in the prior art consoles is the absence of an easy and effective way of adjusting the level of the monitor and of the keyboard to suit a variety of operators, especially when the individual consoles are to be used by more than one operator.

It is, therefore, the object of the present invention to provide a modular console structure adapted to be arranged to provide a work stations that is simple in construction and inexpensive.

It is a further object of the present invention to provide a console framework that can accommodate variously sized computer equipment and has the ability to provide adjustment on installation of the components.

These objects, as well as others, will be apparent from the following disclosure of the present invention.

SUMMARY OF THE INVENTION

In accordance with the present invention, an electronic work station is provided having a console enclosure for supporting various computer or electronic components.

The work station comprises a modular console formed with at least a front and rear structural walls, a table extending forwardly from said wall for supporting a keyboard and a shelf located between said structural walls for supporting a monitor. The shelf and the structural walls are provided with cooperating fixed bracket means attaching the shelf to the structural walls to enable the height and tilt of said monitor to be independently selected.

Preferably, the bracket means comprises a pair of plates extending inwardly from each of the front and rear walls.

Each of the plates has a plurality of parallel slots interconnected by a vertical slot, while the shelf has rod stubs extending laterally from the sides thereof in paired axial alignment. The rod stubs are insertable within a selected slot in a corresponding plate and are selectively movable from slot to slot together with the table independently of each other.

Full details of the present invention are set forth in the following description and are illustrated in the accompanying drawings.

DETAILED DESCRIPTION OF THE INVENTION

Figure 1:
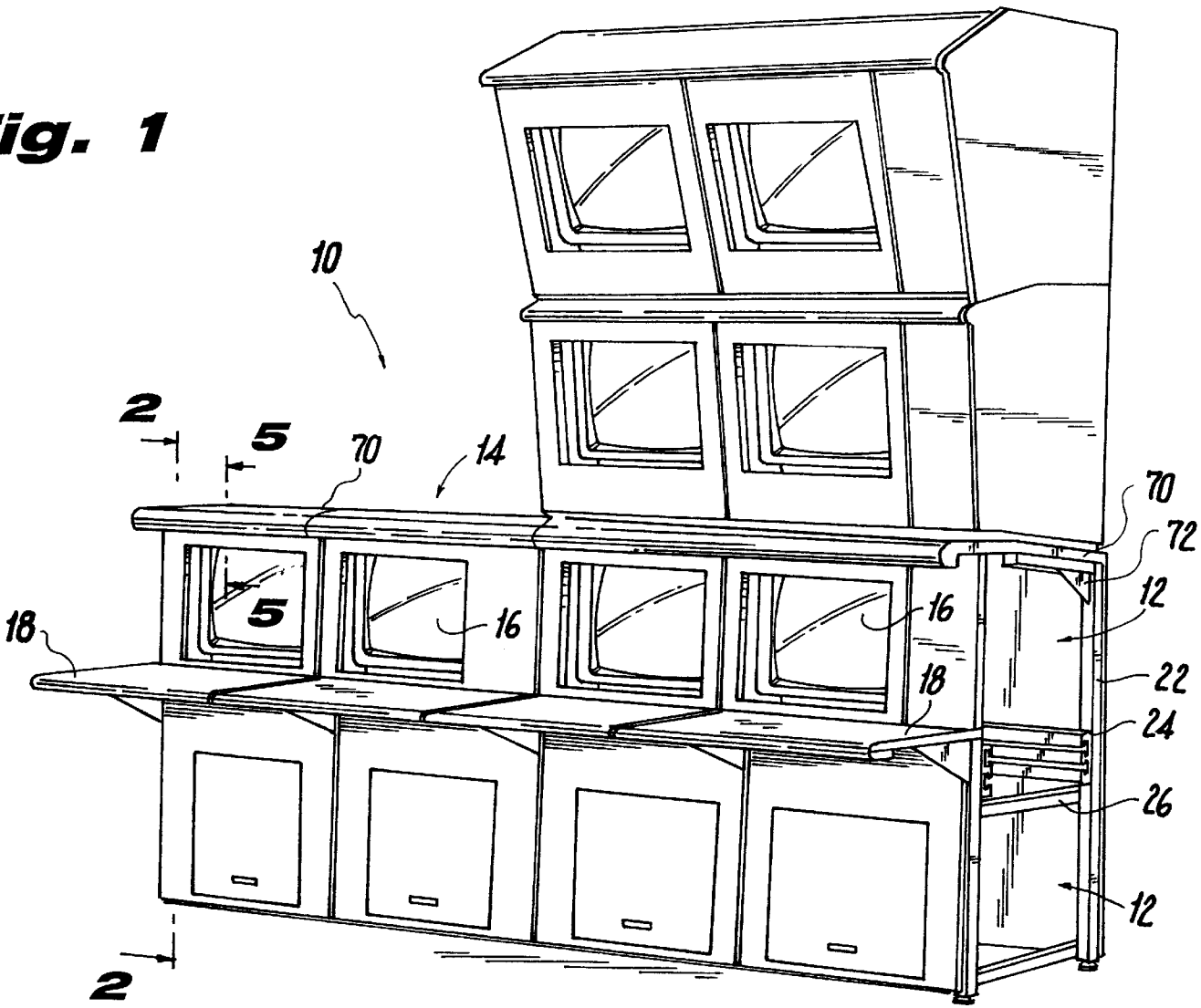
FIG. 1 is a perspective view of a multiconsole arrangement constructed in accord with the present invention.

As seen in FIG. 1, the present invention is adapted to provide console modules as part of a multi-unit system such as used in telecommunications monitoring installations, multifacility control systems, and the like. In such installations a number of terminals, each having a keyboard and monitor, are networked into remote large mainframe computers (not shown). Sometimes each terminal may be provided with two or more monitors, stacked one on another, to provided the operator with multiple views.

Figure 2:
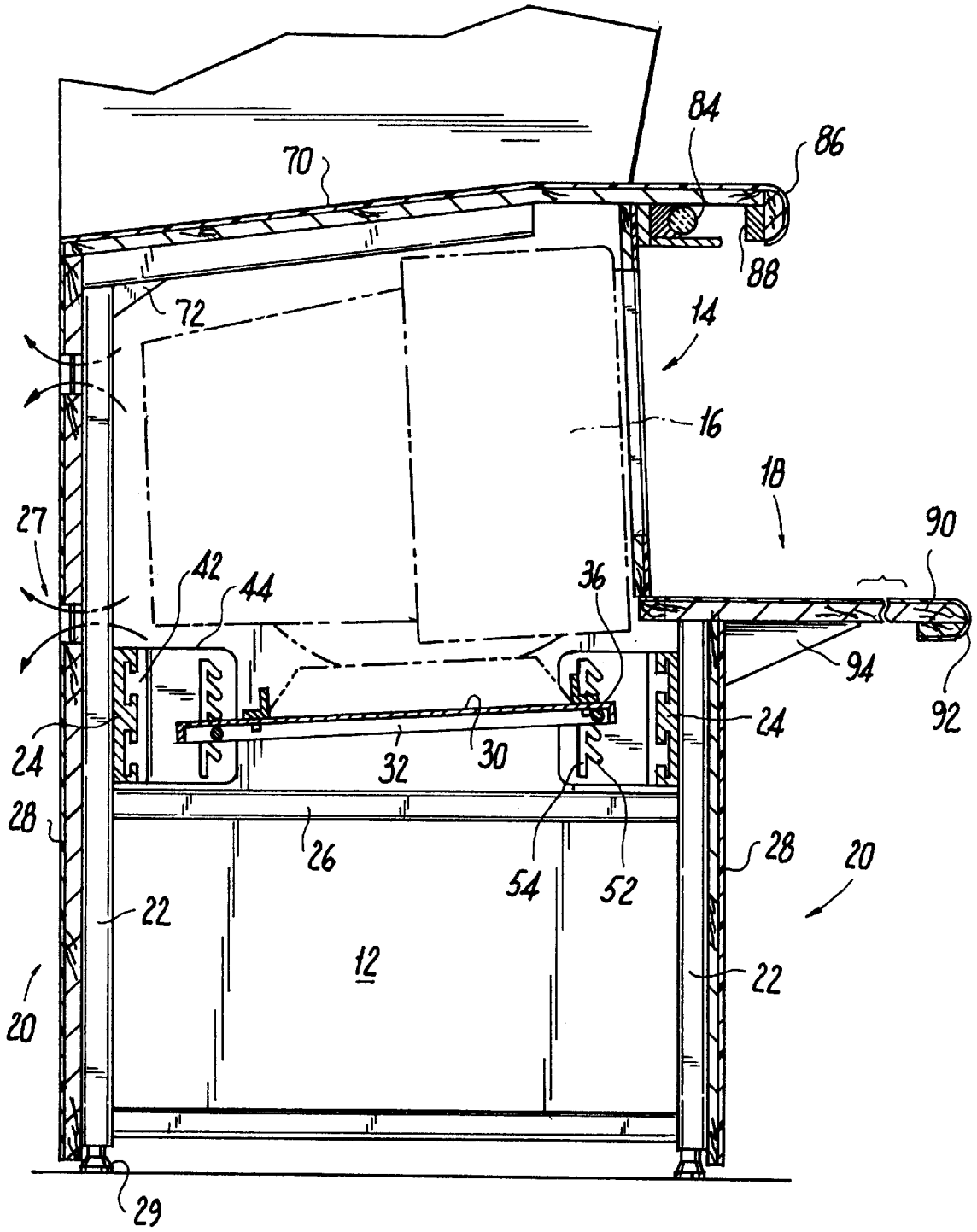
FIG. 2 is a partially sectioned view of the console framework showing schematically the construction thereof.

As seen in FIGS. 1 and 2, the console comprises one or more unitary enclosures generally depicted by the numeral 10, defining a hollow base 12 over which is formed an open-front canopy 14 in which it is housed a monitor 16 (CRT) or other electronic component. Adjustably mounted to the base 12 in front of the canopy 14, is a table 18 on which for example, a keyboard may be placed.

As seen in FIG. 2, the enclosure 10 formed of front and rear wall members 20, each comprising a pair of tubular corner posts 22 interconnected by one or more horizontal braces 24, which, as will be seen herein after also serve as hangers for the monitor support. Depending upon the height and width of the front and rear walls, one or two braces will be sufficient. The front and rear wall members 20 are also interconnected by side braces 26. Each of the braces 24 and side braces 26 are formed of U-shaped channel members, which inherently have sufficient strength to maintain the wall rigid.

The individual channel members also have the ability to hide the required fasteners such as set screws or the like fastening the braces to the posts. The U-shaped channels are preferably provided with a series of spaced or arrayed holes for allowing quick connection of the fasteners with a minimum of tools. The wall members 20 are completed by covering them with panel facia 28 which are decoratively finished for both aesthetic and wear characteristic. The rear panels may be provided with air holes or louvers 27 for the ventilation of the enclosed equipment.

The panels are preferably attached by set screws or the like to the posts and braces from the interior of the enclosure to avoid their interference with the operator. To this end, blind bore are formed in a uniform spacing along the marginal edge of each panel. In this manner, a rectangular enclosure of any selected size can be formed by simply employing at least two panels, arranged parallel to each other to define front and rear walls. The missing side walls may be formed by sheathing them with decorative panels secured to the associated corner posts of the front and rear walls. The vertical corner posts are leveled by any conventional adjustable foot 29. Such leveling feet are widely commercially available.

It is to be appreciated that in arranging a series of contiguous consoles, that is one abutting an other, that space and materials can be conserved by utilizing the corner posts and enlarged horizontal braces for adjacent consoles and providing panel facia adapted to extend over more than one enclosure. Further, in providing for abutting consoles, the side walls of the enclosure can be omitted since the interior of the enclosures will be hidden from view by the adjacent console. The end consoles in any arrangement will be provided with a panel facia unless, of course, they are, in fact, set abutting to a building wall.

Clearly, the enclosures, thus constructed, are modular units being capable of being built in a variety of sizes to fit most any site. On the other hand, the construction can be customized to conform to the specific and often unique requirements of the user. Cutting of the post and brace length and modifying angling of adjacent consoles can be made without the use of expensive tools.

The enclosure, thus described, lends itself to the application of certain improvements, provided by the present invention. A significant improvement is obtained by providing a novel monitor supporting table which is adjustable both in height and in tilt.

Figure 3:
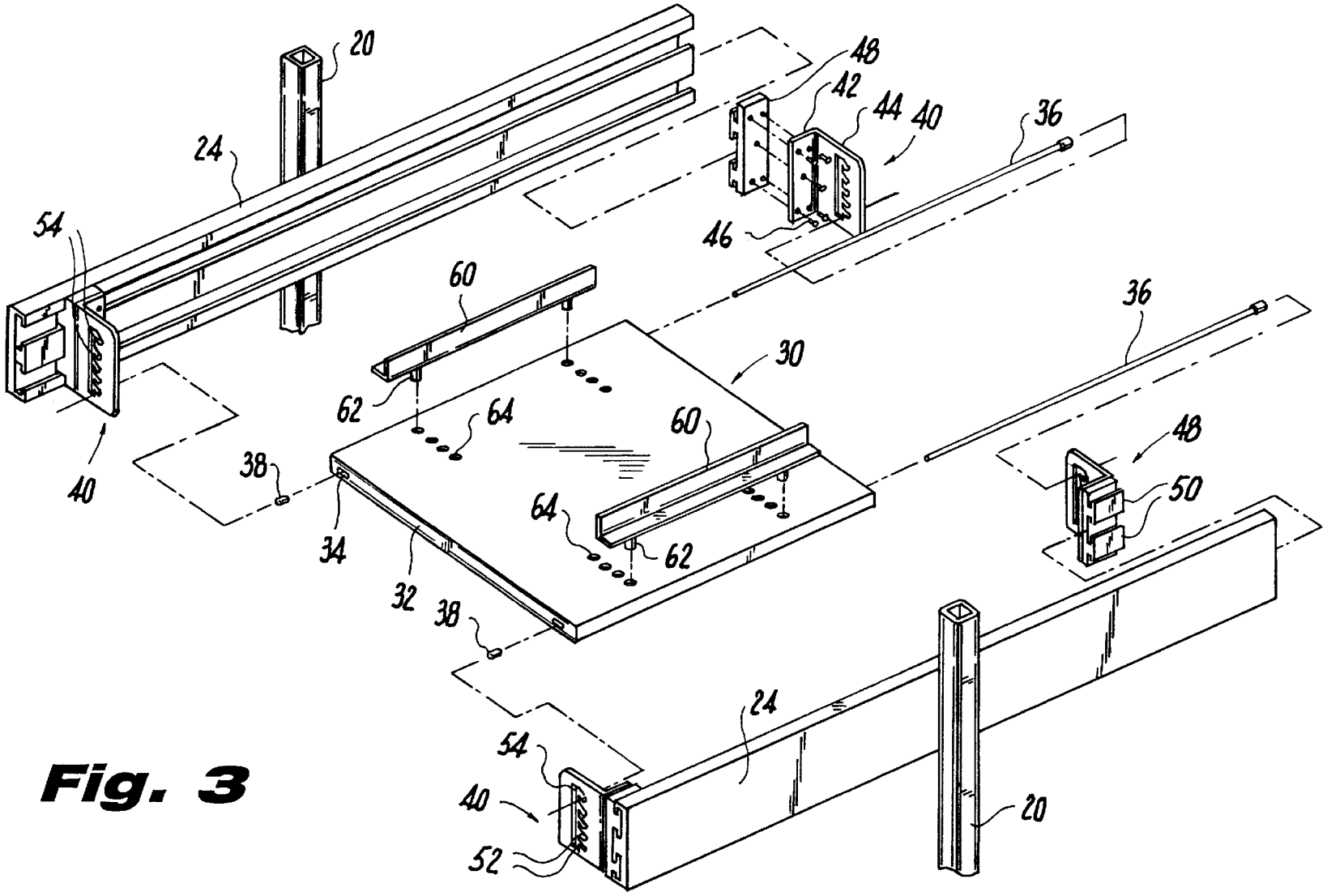
FIG. 3 is an exploded and expanded view of the monitor shelf and adjustable bracket assembly.

The monitor support, as seen in detail in FIG. 3, comprises a generally rectangular shelf 30. The shelf may be a solid block, or a thin sheet provided with integral skirts along its edges 32 so as to be stable, non-twistable and non-flexible. The shelf 30 is provided with a through hole 34, inward of its front and rear edges running parallel to the front and rear edges from side to side. An elongated rod 36 is inserted within each hole 34 so that one rod will be parallel to the front structural wall, while the other rod is parallel to the rear wall. Each end of each rod 36 is covered with a push nut 38 to prevent the rod from falling out. Each rod 36 itself is somewhat longer than the width of the shelf 30 so that at each end, a stub portion extends away from the side edge of the shelf 30.

The supporting shelf is adjustably mounted on four bracket assemblies 40 secured to the posts 22 of the front and rear frame walls of the enclosures 10. Each bracket assembly 40 comprises an L-shaped plate comprising a short leg 42 and a long leg 44 perpendicular to each other; both oriented in a vertical direction. The short leg 42 is secured by a plurality of set screws 46 to a backing 48, the rear side of which is formed with at least two horizontally T-shaped square undercut male slide members 50 defining one half of a mating dovetail slide. The larger plate 44 is provided with a plurality of downwardly inclined cut-outs in the form a parallel fingers 52 joined at their base by a common vertical interconnecting slot 54.

The bracket assemblies 40 are secured in pairs on horizontally extending hangers 56 extending the entire width of the front and rear frame wall members 20 respectively. The hangers 56 are fixedly secured by set screws from the rear of the tubular corner posts 22, and are each provided on their face with continuous female slide grooves 58 defining the second half of the mating dovetail slide.

In assembling the console, the front and rear pairs of the bracket assemblies 40 are slidably dovetailed into the hangers 24 and adjustably positioned in the lateral direction centered in the open front console canopy 14 with the rear pair of bracket assemblies 40 aligned directly behind the front pair. The fingers 52 in each bracket are oriented in the same in the same direction, preferably toward the front of the enclosure.

The brackets 40, thus, extend fixedly in a stable position inwardly of the console enclosure. The monitor supporting shelf 30 is then placed between the brackets assemblies 40 and the stub ends of the rods 36 protruding from each side of the shelf inserted in and passing through one of the associated fingers 52 of the bracket and held in place by the push nuts 38. Because of the weight of the supporting shelf 30 and the monitor 16 when placed on it, the shelf has a downward thrust which causes the stub ends of the rods 36 to seat within one of the selected fingers 52, locking the shelf in place. By shifting the shelf forwardly and/or rearwardly, the shelf 30 is loosened and the rods 36 may be placed via the common interconnecting slot 54 in another selected finger, thus moving the shelf 30 up or down into another level or tilt.

With the foregoing arrangement, the monitor supporting shelf may be raised and lowered and/or tilted fore and aft as desired to position the monitor at a desired height and angle. The front and rear edges of the shelf can be manipulated independently of each other so that the shelf can be tilted at both, the front and rear end. Raising and lowering of the shelf is independent of the tilt, as is the tilting of the shelf.

One or more safety bars 60 may be secured to the surface of the shelf 30 to prevent the monitor from sliding on the tilted shelf. To this end, the safety bar 50 is provided with protruding pegs 62 on its lower edge which will force fit into corresponding spaced holes 64 in the surface of the shelf 30. The shelf is preferably provided with a plurality of spaced holes 64 so that the safety bar 60 may be most conveniently placed to fit the size of the monitor base and the selected tilt of the shelf.

The canopy 14 of the enclosure 10 is formed of a sheet-like roof 70, secured by a pair of triangular side gussets 72, which are attached at their rear to the corner posts 22 of the rear wall. When stacked installations are made, the gussets 72 and roof 70 may be reinforced to have the necessary strength to carry the upper load. The roof 70 may even be removed and replaced with a supporting floor. The roof 70 may be tilted upwardly in single stack arrangement laid flat or even downwardly tilted when an upper stack is used.

At the front end of the canopy roof 70, is a lamp 84, preferably contained in its own U-shaped housing 86 as to illuminate the keyboard table 18. On the other hand, the canopy 70 may be formed with a U-bend, at its front end, into which the lamp 84 may be secured. In either case, a suitable heat shield and reflector lining 88 within the housing is provided.

Figure 4:
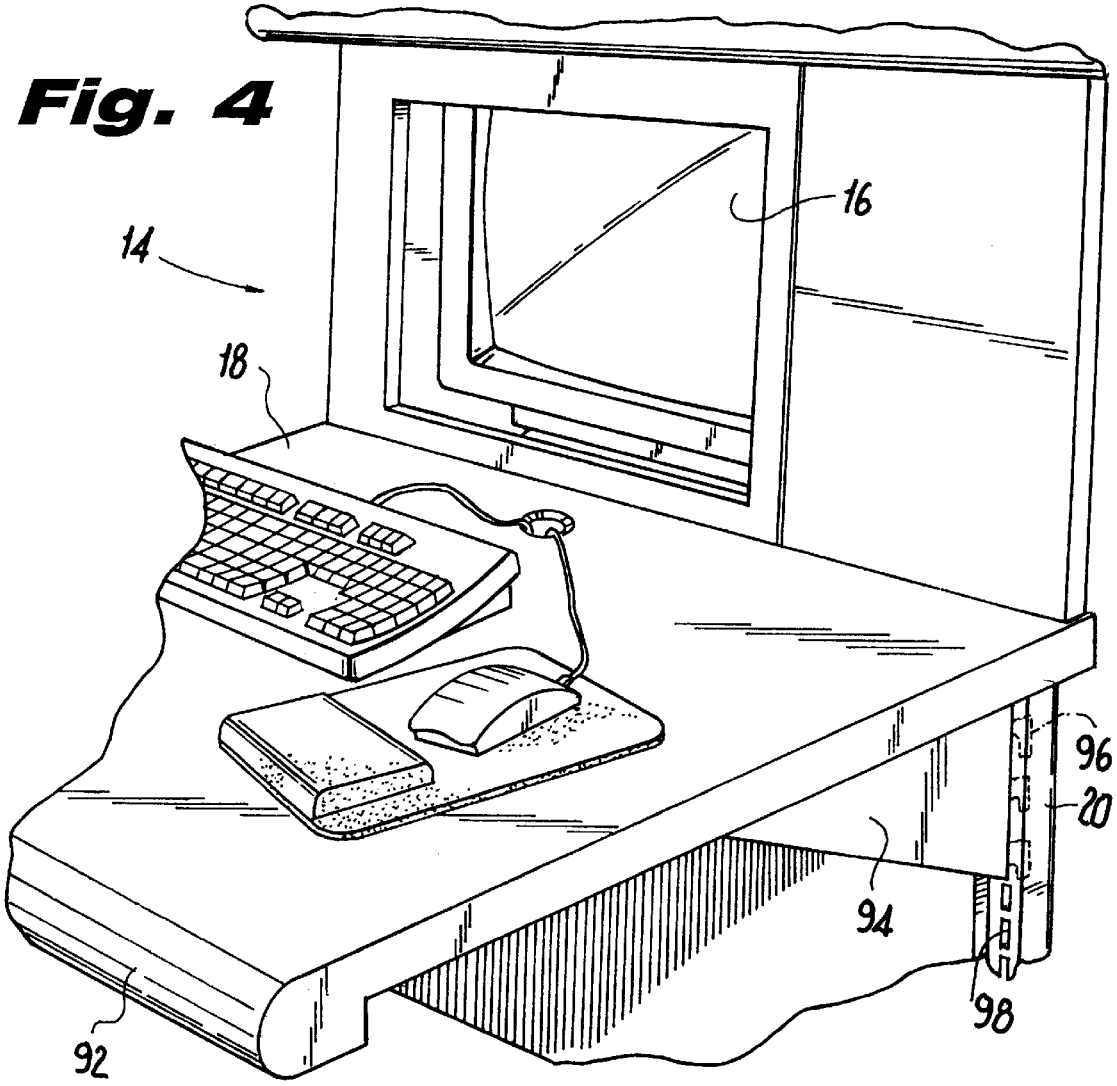
FIG. 4 is an exploded and expanded view of the keyboard table and it's adjustable bracket assembly.
Figure 5:
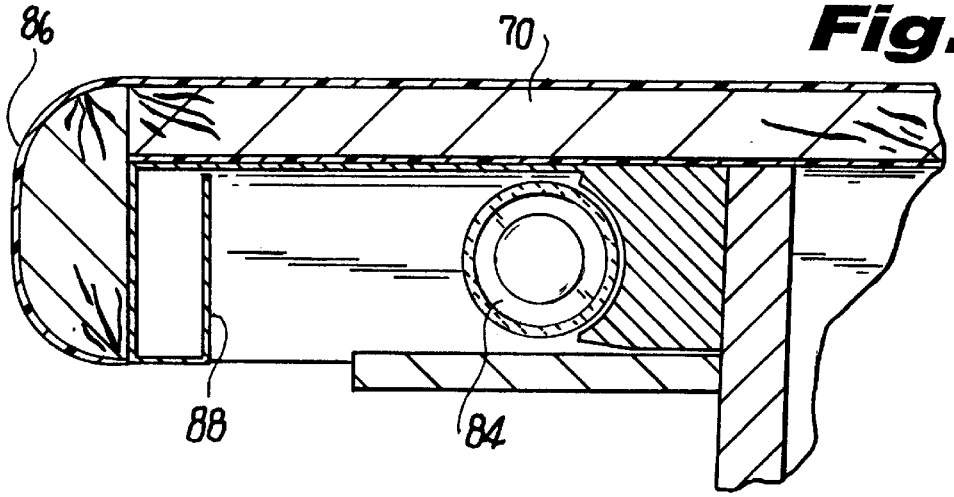
FIG. 5 is a larger section view of a portion of FIG. 2.

The keyboard table 18, as seen in detail in FIG. 4, is formed of a block or stamped sheet 90 having bullnose edges 92 for safety as well as decoration. Preferably, the keyboard table 18 is secured at its side to gussets 94, which are themselves adjustably attached to the tubular posts 22 of the front wall. The keyboard table 18 may include roller track slide supports which permit the table to be pulled out as needed and pushed when not in use.

The gussets 72 and the gussets 94 may be integrally fabricated with their respective canopy 70 and keyboard table 18 for added strength or they may be removably attached for convenience. Each of the vertical edges of both sets of gussets may be provided with spaced keys 96 (FIG. 4), while the associated corner posts are provided with spaced slots 98 into which the keys 96 cooperatively engage. In this manner, the canopy roof 70 and keyboard table 18 may be removably and adjustably attached to the enclosure. This is particularly advantageous, with regard to the keyboard table 18, since its height may thus be easily adjusted for the individual user. Similar height adjustment can be made for the canopy to accommodate enlarged monitors. The canopy may also be easily removable to be replaced with a flat structure, of similar design, to support a second level monitor.

It will be understood that the enclosure components may be made of aluminum, steel, wood, plastics or any combination thereof as is customary and usual in the act. Preferably the corner posts are steel for added strength, while the panels may be plastic, wood or aluminum as desired. If a metal is used, the metal may be coated with a plastic or wood laminate for decoration or noise reduction.

Various modifications and changes have been disclosed herein and others will be obvious to those skilled in the present art. It is, therefore, to be understood that the disclosure is illustrated only and not limiting of the invention.

What is claimed is:

1. In a work station comprising a console having front and rear vertical walls and a carrier shelf mounted therein, a mounting assembly for said carrier shelf comprising:

a pair of plate brackets mounted on each of the front and rear walls in lateral spaced alignment to extend inwardly in a vertical plane normal to said walls, each of said plate brackets having a plurality of angular slots interconnected by a common slot and being disposed so that the angular slots of each bracket are in the same direction, said carrier shelf having front and rear ends which fit between said front and rear walls and between the associated pairs of plate brackets, and projections attached to said carrier shelf adjacent each of its corners of its ends extending laterally therefrom parallel to said front and rear walls, said projections being insertable within a selected one of said slots of a corresponding bracket and movable from slot to slot to selectively adjust the vertical position of the front and rear ends of said shelf singly or together without removal of the shelf.

2. The mounting assembly according to claim 1, wherein said slots are disposed at a downward incline.

3. The mounting assembly according to claim 2, wherein each bracket plate is formed in an L-shape, the longer leg of which contains the slots and the shorter leg being secured to its associated wall.

4. The mounting assembly according to claim 3, wherein the shorter leg and the wall are provided with cooperating dovetailing means for slidably attaching said bracket plate to said wall.

5. The work station according to claim 4, wherein the dovetailing means on said wall comprises a plurality of grooves, and said dovetailing means on said bracket comprises shaped detent means corresponding to said grooves.

* * * * *